United States Patent [19]

Ikenoue et al.

[11] 4,181,530

[45] Jan. 1, 1980

[54] THERMALLY DEVELOPABLE LIGHT-SENSITIVE MATERIAL HAVING REDUCED FOG

[75] Inventors: Shinpei Ikenoue; Nobuyoshi Sekikawa; Takao Masuda, all of Asaka, Japan

[73] Assignee: Fuji Photo Film Co., Ltd., Minami-ashigara, Japan

[21] Appl. No.: 924,589

[22] Filed: Jul. 14, 1978

[30] Foreign Application Priority Data

Jul. 15, 1977 [JP] Japan ..... 52-84699

[51] Int. Cl.[2] ..... G03C 1/02; G03C 1/34; G03C 1/06; G03C 5/24

[52] U.S. Cl. ..... 430/620; 430/353

[58] Field of Search ..... 96/114.1, 109, 77, 95, 96/96, 112, 48 HD, 66 T, 48

[56] References Cited

PUBLICATIONS

J. Org. Chem., 23 pp. 420–426, (1958), McDaniel et al., Hammett Substituent Constants.

*Primary Examiner*—Travis Brown
*Assistant Examiner*—Louis Falasco
*Attorney, Agent, or Firm*—Sughrue, Rothwell, Mion, Zinn and Macpeak

[57] ABSTRACT

A thermally developable light-sensitive material wherein heat fog is prevented comprising a support having therein or in one or more layers thereon (a) an organic silver salt, (b) a photo catalyst and (c) a reducing agent and containing (d) a phthalimide having at least one electron-attracting substituent, such as a halogen atom or an acyl group.

18 Claims, No Drawings

THERMALLY DEVELOPABLE LIGHT-SENSITIVE MATERIAL HAVING REDUCED FOG

BACKGROUND OF THE INVENTION

1. Field of the Invention

This invention relates to a thermally developable light-sensitive material, and more specifically, to a thermally developable light-sensitive material in which heat fog is prevented, and storage stability in the unexposed state is improved, by the addition of a novel stabilizer.

2. Description of the Prior Art

Photography using silver halides has gained the most widespread acceptance because silver halide photography provides better photographic characteristics such as sensitivity or contrast than other photographic processes such as electrophotography or diazo photography. In recent years, various techniques have been investigated and developed to change the image-forming processing of silver halide photographic materials from a conventional wet treatment with developing solutions, etc., to the dry treatment by heating, etc.

The most successful light-sensitive materials which can be used to obtain photographic images using a dry processing method is a thermally developable light-sensitive material based on the utilization of a composition comprising an organic silver salt, a small amount of a photo catalyst such as a silver halide, and a reducing agent, disclosed, for example, in U.S. Pat. Nos. 3,152,904 and 3,457,075. This type of light-sensitive material is stable at room temperature. When the material is imagewise exposed, and then heated to a temperature of usually at least about 80° C., preferably at least 100° C., the organic silver salt as an oxidizing agent and the reducing agent in the light-sensitive layer undergo an oxidation-reduction reaction due to the catalytic action of metal nuclei generated from the photo catalyst, such as exposed silver halide in proximity thereto, thereby to form silver. As a result, the exposed area of the light-sensitive layer rapidly blackens to provide a contrast between the exposed area and the unexposed area (background), and, thus, a stable silver image which does not require fixation is formed.

With conventional thermally developable light-sensitive materials, considerable blackening frequently occurs in the unexposed area (this phenomenon will be referred to herein as "heat fog"), and the contrast between the background and the blackened areas (image areas) formed upon exposure is decreased. Thus, the image is difficult to discern. An important problem, therefore, is to reduce the amount of heat fog. Furthermore, when a thermally developable light-sensitive material is stored for a long period of time before it is used, frequently an increase in fog, a decrease in image density, a decrease in sensitivity, and a deterioration in color, which are not observed in the light-sensitive material before storage, occur. It is desired, therefore, to provide thermally developable light-sensitive materials in which these changes in photographic characteristics do not occur during storage (namely, which have good storage stability in the unexposed state).

Various stabilizers have already been developed for preventing heat fog in thermally developable light-sensitive materials or for improving their storage stability in the unexposed state. Typical examples of such stabilizers are mercury compounds, N-halo compounds, lithium compounds, persulfates, sulfinic acids, thiosulfinic acids, rosin acid, acidic polymers, 1,2,4-triazoles and imidazoles which are disclosed, for example, in U.S. Pat. Nos. 3,589,903, 3,957,493 and 3,885,968, Japanese Patent Application (OPI) Nos. 101019/75 (corresponding to British Pat. No. 1,460,868), 116024/75 (corresponding to British Pat. No. 1,480,704), 123331/75 (corresponding to British Pat. No. 1,476,875), 134421/75, 47419/76, 42529/76, 51323/76, 57435/76 (corresponding to U.S. Pat. No. 4,039,334), 78227/76, 104338/76 and 112452/75 (The term "OPI" as used herein refers to a "published unexamined Japanese patent application"), and Japanese Patent Application (OPI) Nos. 24520/77 and 32015/78. Organic carboxylic acid compounds such as long-chain carboxylic acids, benzoic acids, or phthalic acids have also been used as such stabilizers.

However, these conventional stabilizers have not proved to be entirely effective for preventing heat fog of thermally developable light-sensitive materials or improving their storage stability in the unexposed state. Generally, when these stabilizers are used in large quantities, heat fog is reduced, but at the same time, the stabilizers adversely affect the light-sensitive material causing, e.g., a decrease in maximum image density ($D_m$), a decrease in sensitivity or a deterioration in color. When these stabilizers are used in amounts at which these adverse effects do not occur, the desired effects of heat fog prevention and of improving storage stability in the unexposed state tend to be reduced. In addition, these conventional stabilizers have only a narrow latitude of the optimal amounts to use, and difficulties are encountered in their use. Accordingly, a great need exists for stabilizers which do not cause these adverse effects to occur.

Extensive investigations have been made in an attempt to solve these problems of prior art techniques, and it was found that phthalimides having electron-attracting substituents have very good properties for use as stabilizers for thermally developable light-sensitive materials.

SUMMARY OF THE INVENTION

An object of this invention is to provide a thermally developable light-sensitive material containing a stabilizer which serves to prevent heat fog and improve storage stability in the unexposed state without decreasing $D_m$, decreasing sensitivity and deteriorating color.

This object is achieved in accordance with this invention by a thermally developable light-sensitive material comprising a support having therein or in one or more layers thereon (a) an organic silver salt, (b) a photo catalyst and (c) a reducing agent and, further, containing (d) a phthalimide having at least one electron-attracting substituent.

DETAILED DESCRIPTION OF THE INVENTION

Addition of phthalimides to thermally developable light-sensitive materials is known. For example, German Patent Application (OLS) No. 2,141,063 (corresponding to British Patent 1,380,795) describes the addition of phthalimides not as stabilizers but as toning agents. Furthermore, these prior art references disclose only those phthalimides which have electron-donating substituents such as alkyl, cycloalkyl, cycloalkoxy, aralkyl or aralkoxy groups. As described above, it has now been found surprisingly that phthalimides having electron-attracting substituents have a weak toning action but also a fog-preventing action, whereas phthalimide and phthalimides having electron-donating substituents have only a toning action, and no fog-preventing action (but rather increase fog).

On the other hand, U.S. Pat. No. 3,782,941 describes the addition of naphthalimides having a hydroxy group or a carbamoyloxy group $$(-O-\overset{O}{\overset{\|}{C}}-NHR)$$

as a substituent at the N-position thereof to the thermally developable light-sensitive material to improve the image tone. But it has now been found that the addition of such naphthalimide derivatives causes a deterioration in the light discoloration property.

An important feature of the present invention lies in the fact that a phthalimide having at least one electron-attracting substituent is present as a stabilizer in a thermally developable light-sensitive material of the conventional type. Suitable phthalimides which can be used are phthalimides or naphthalimides which have at least one electron-attracting group as a substituent. Hereinafter, for brevity, the term "phthalimide" will be used to describe both phthalimides and naphthalimides.

The term "electron-attracting group", as used herein to describe the nature of the substituent present on the phthalimide as component (d), denotes a substituent having a positive Hammett substituent $\sigma$ constant (as described in, for example, D. H. McDaniel & H. C. Brown, *J. Org. Chem.*, 23, pp. 420 (1958), and I. L. Finar, *Organic Chemistry*, 1, pp. 563–566 (1967), Longmans, London). Electron-attracting groups as substituents having a $\sigma$ constant of $0<\sigma<1$ are preferred.

Examples of suitable electron-attracting substituents which can be present on the phthalimide include one or more of a cyano group; a halogen atom such as fluorine atom, a bromine atom, a chlorine atom and an iodine atom; a nitro group; an acyl group containing 2 to 20 carbon atoms such as an acetyl group, a propionyl group, a butyryl group, a palmitoyl group, a stearoyl group, a benzoyl group, a toluoyl group, etc.; an acyloxy group having 2 to 20 carbon atoms such as an acetyloxy group, a propionyloxy group, a butyryloxy group, a palmitoyloxy group, a stearoyloxy group, a benzoyloxy group, etc.; an alkoxycarbonyl group having 2 to 20 carbon atoms such as an ethoxycarbonyl group, a benzyloxycarbonyl group, etc.; an acylamino group having 2 to 20 carbon atoms such as an acetylamino group, a propionylamino group, a benzoylamino group, a palmitoylamino group, etc.; an acylthio group having 2 to 7 carbon atoms such as an acetylthio group, a propionylthio group, etc.; and a sulfonamido group having 1 to 10 carbon atoms such as an N,N-dimethylsulfonamido group, an N-phenylsulfonamido group, etc.

Of these various substituents described above, halogen atoms are especially preferred as electron-attracting substituents.

As described above, the phthalimides used as component (d) in this invention may also contain two or more electron-attracting substituents.

Examples of preferred phthalimides having at least one electron-attracting substituent are those of the following general formulae (I) and (II):

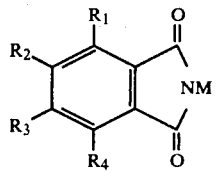

(I)

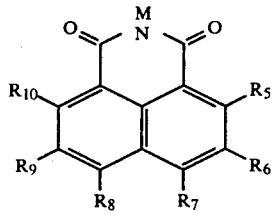

(II)

wherein M represents a hydrogen atom or a monovalent metal atom, preferably an alkali metal atom such as a lithium atom, a sodium atom, a potassium atom, a rubidium atom or a cesium atom; at least one of $R_1$, $R_2$, $R_3$ and $R_4$, or at least one of $R_5$, $R_6$, $R_7$, $R_8$, $R_9$ and $R_{10}$, represents an electron-attracting substituent as defined hereinabove; and the other of $R_1$ to $R_4$, or the other of $R_5$ to $R_{10}$, not representing an electron-attracting substituent, each can be the same or different and represents a hydrogen atom, a hydroxyl group, or a carbon-containing substituent containing 1 to 20 carbon atoms. Examples of suitable carbon-containing substituents are an alkyl group, which can be straight chain, branched chain or cyclic, having up to 12, especially 1 to 4, carbon atoms (e.g., a methyl group, an ethyl group, a propyl group, a butyl group, a hexyl group, an octyl group, etc.), an alkoxy group, which can be straight chain or branched chain, having 1 to 12, especially 1 to 4, carbon atoms (e.g., a methoxy group, an ethoxy group, a propoxy group, a butoxy group, a hexyloxy group, etc.), and an aryl group having 6 to 12 carbon atoms (e.g., a phenyl group or a naphthyl group), especially a phenyl group or a tolyl group. A hydrogen atom is most preferred for those of $R_1$ to $R_4$ and for those of $R_5$ to $R_{10}$ which do not represent an electron-attracting substituent.

A phthalimide compound with both an electron-attracting substituent and an electron-donating substituent is feasible in the present invention, providing such compound has a half neutralization point higher than that of unsubstituted phthalimide or naphthalimide.

A method of measuring the half-neutralization point is described in I. Gyenes, et al., *Titration in Non-Aqueous Media*, Chapter 2, London Iliffe Books Ltd. (1967), and this method is employed herein in measurement of the half-neutralization point.

More specifically, prior to the determination of the half-neutralization point, a standard solution containing $5\times10^{-4}$ mol of phthalimide or naphthalimide dissolved in 50 ml of isopropanol is titrated with a titration solution prepared by diluting a 10% by weight methanol solution of n-tetrabutylammonium hydroxide with isopropanol to a concentration of 0.1 mol/l. The measured value of the half-neutralization point is based on the electric potential of the standard solution obtained when half of the amount of the titration solution required for reaching an equivalence point has been added to the standard solution.

Generally, the measurement of the electric potential can be performed using a combination of a glass electrode, a suitable standard electrode (e.g., calomel electrode, silver chloride electrode, etc.) and a pH meter. For example, a Type HGS-2005 glass electrode (manufactured by TOA DENPA Co., Ltd.), a double junction type silver electrode (manufactured by DENKI KAGAKU Co., Ltd.) as a standard electrode and an HM-18B pH meter (manufactured by TOA DENPA Co., Ltd.) can be used in combination.

The half-neutralization of various types of phthalimide compounds with both an electron-attracting substituent and an electron-donating substituent in isopropanol can be determined using the above-described procedure, and the phthalimide compounds whose measured values are greater than the half-neutralization point of (unsubstituted) phthalimide or naphthalimide can be used as component (d) of the present invention. Preferred phthalimide compounds are those which have a half-neutralization point of more than the half-neutralization point of phthalimide or naphthalimide +10 mV.

Specific examples of preferred phthalimides (d) are 3-bromophthalimide, 4-bromophthalimide, potassium 4-bromophthalimide, lithium 4-bromophthalimide, sodium 4-bromophthalimide, 3,4-dibromophthalimide, 4-chlorophthalimide, 3-chlorophthalimide, 4,6-dibromophthalimide, 4,5-dichlorophthalimide, 3-fluorophthalimide, 4-fluorophthalimide, 3-iodophthalimide, 4-iodophthalimide, 3,6-iodophthalimide, 3,6-dichlorophthalimide, 3,4,5,6-tetrabromophthalimide, 3,4,5,6-tetrafluorophthalimide, 3,4,5,6-tetraiodophthalimide, 3-acetylaminophthalimide, 4-acetylaminophthalimide, 3-nitrophthalimide, 4-nitrophthalimide, 4-benzoylphthalimide, 3-cyanophthalimide, 4-cyanophthalimide, 3,4-dicyanophthalimide, 3-acetylamino-6-N,N-dimethylaminophthalimide, 3-acetylamino-6-nitrophthalimide, 3-chloro-4-methoxyphthalimide, 4-N,N-dimethylaminosulfophthalimide, 4-methoxyphthalimide, 3-acetylamino-6-bromophthalimide, 4-bromonaphthalimide, 4-nitronaphthalimide, 4-chloronaphthalimide, 3,5-dichloronaphthalimide, and 3,4,5-trichloronaphthalimide. Of the above-exemplified phthalimides, phthalimides represented by the general formula (I) above are more preferred than those represented by the general formula (II) above.

Methods for synthesis of the phthalimides which can be used in this invention are known, and those skilled in the art can easily synthesize them by reference to the disclosure in, for example, Hans Waldmann, *J. Prakt. Chem.*, 26, pp. 65–68 (1930); L. M. Yagupolisdii, et al., *Zh. Obshch. Khim.*, 33 (7), pp. 2358–2364 (1963); Y. Bansho, et al., *Tokyo Kogaku Shikenzyo Hokoku*, 56, pp. 158–164 (1961); etc.

The amount of component (d) cannot be set forth unequivocally because the amount will vary depending upon the type of the organic silver salt (a) or the reducing agent (c) also present. Generally, the phthalimide component (d) is used in an amount of about 0.001 mol to about 0.2 mol, preferably 0.005 to 0.1 mol, per mol of the organic silver salt (a). When the amount of the component (d) is too small, the effect achieved in the present invention is reduced. When the amount of component (d) is too large, the maximum density ($D_m$) and the developing speed will be reduced.

The phthalimides (d) may be used individually or as a mixture of two or more thereof.

Component (d) may be incorporated into a layer containing components (a) and (b) (this layer will be referred to herein as a light-sensitive layer), a top layer formed on the light-sensitive layer, a subbing layer formed between the surface of the support and the light-sensitive layer, or in the support.

When all or some of the components (a), (b) and (c) of the thermally developable light-sensitive material are present in the support, component (d) may be present in the support or in a layer formed on the surface of the support.

Preferably, component (d) is incorporated into the thermally developable light-sensitive material during the production of the light-sensitive material. Component (d) can also be incorporated into the light-sensitive material by coating a solution containing component (d) on the thermally developable light-sensitive material after production but before development by heating.

In a preferred embodiment, component (d) is incorporated in the light-sensitive layer since in this case the best effect is achieved with component (d). In this case, component (d) may be added to a coating composition for preparing the light-sensitive layer. In an alternative embodiment, a solution containing component (d) can be coated on the light-sensitive layer immediately after the formation of the light-sensitive layer to impregnate the light-sensitive layer with component (d). Component (d) can also be introduced into the light-sensitive layer by coating the coating composition for the light-sensitive layer on a subbing layer formed by coating a subbing coating composition containing component (d).

Component (d) can be added in the form of a solid powder or as a solution or dispersion in a suitable liquid such as water, methanol, ethanol, acetone, methyl ethyl ketone, cyclohexane, dioxane, toluene, benzene, ethyl acetate, tricresyl phosphate, an ethylene glycol monoalkyl ether, or dimethylformamide.

The organic silver salt, which is used as component (a) in the present invention, can be a colorless, white or slightly colored silver salt, capable of reacting with a reducing agent, imagewise or in the presence of an exposed photocatalyst, on heating at a temperature of about 80° C. or higher, preferably 100° C. or higher, and then forming silver (image). Suitable organic silver salts which can be used include silver salts of organic compounds containing an imino group, a mercapto group or a thione group, or a carboxyl group. Specific examples of suitable organic silver salts which can be used as component (a) in the present invention include the following compounds:

(1) Silver salts of organic compounds containing an imino group:

For example, silver salts as disclosed in Japanese Patent Application (OPI) No. 22431/76, e.g., silver benzotriazole, silver saccharin, and silver phthalazinone, etc.;

(2) Silver salts of compounds containing a mercapto group or a thione group:

For example, silver salts as disclosed in Japanese Patent Application (OPI) No. 22431/76, U.S. Pat. Nos. 3,933,507 and 3,785,830, e.g., silver 2-mercaptobenzoxazole, silver mercaptooxadiazole, silver 2-mercaptobenzothiazole, silver 2-mercaptobenzimidazole and silver 3-mercapto-4-phenyl-1,2,4-triazole, etc.;

(3) Silver salts of organic compounds containing a carboxyl group:

For example:

(A) Silver salts of aliphatic carboxylic acids; silver salts as disclosed in Japanese Patent Application (OPI) No. 22431/76, U.S. Pat. No. 3,457,075 and Japanese Patent Application (OPI) No. 99719/75, e.g., silver laurate, silver myristate, silver palmitate, silver stearate, silver arachidonate, silver behenate, silver salts of aliphatic carboxylic acids having 23 or more carbon atoms, silver adipate, silver sebacate, and silver hydroxystearate, etc.;

(B) Silver salts of aromatic carboxylic acids; silver salts as disclosed in Japanese Patent Application (OPI) Nos. 22431/76 and 99719/75, e.g., silver benzoate, silver phthalate, silver phenylacetate, and silver 4'-n-octadecyloxydiphenyl-4-carboxylate, etc.;

(4) Other silver salts:

For example, silver salts as disclosed in Japanese Patent Application (OPI) Nos. 22431/76 and 93139/70, e.g., silver 4-hydroxy-4-methyl-1,3,3a,7-tetrazaindene, and silver 5-methyl-7-hydroxy-1,2,3,4,6-pentazaindene.

These organic silver salts can be prepared using various methods, e.g., as described in U.S. Pat. Nos. 3,457,075, 3,458,544, 3,700,458 and 3,839,049, British Pat. Nos. 1,405,867, 1,173,426, and 1,408,123, Japanese Patent Application (OPI) Nos. 22431/76, 116024/75, 134421/75, 122011/76 and 57111/77. These organic silver salts can be easily prepared according to these methods.

Of these organic silver salts thus prepared, an organic silver salt having a grain size of from about 10$\mu$ to about 0.01$\mu$ and, more particularly, from about 5$\mu$ to about 0.1$\mu$, in length is preferred.

Of the above-described organic silver salts, an organic silver salt which is relatively stable to exposure to light is suitable. Even further, of these silver salts, a silver salt of a long-chain aliphatic carboxylic acid having 10 to 40 carbon atoms, more preferably 18 to 33 carbon atoms, is preferred. Specific examples of these organic silver salts include silver salts of carboxylic acids of the formula $CH_3(CH_2)_n$—COOH where n ranges from 16 to 31. In addition, a mixture of organic silver salts can be used, if desired.

The amount of the organic silver salt (a) used generally ranges from about 0.1 g to about 4 g of silver, preferably from about 0.2 g to about 2.5 g of silver, per $m^2$ of the support. When the amount of the organic silver salt used is less than about 0.1 g/$m^2$, the image density obtained is too low. On the other hand, even if an amount greater than about 4 g/$m^2$ is used, the image density obtained does not increase, and thus use of an excess amount results in a high cost due to an increased amount of silver used with no attendant advantages accruing.

The photo catalyst (b) used in this invention, when exposed to light, releases a substance which can catalyze the oxidation-reduction image-forming reaction between the components (a) and (c) which is subsequently achieved at the temperature described hereinabove.

Suitable photo catalysts that can be used in this invention are any of those known in the thermally developable light-sensitive material field, such as photosensitive silver halides; photosensitive complexes between silver and dyes as described in Japanese Patent Application (OPI) No. 4728/71, Japanese Patent Publication No. 25498/74 and U.S. Pat. No. 3,933,507; photosensitive organic silver salts as described in Japanese Patent Application (OPI) No. 8522/75; metal diazo sulfonates or sulfinates as described in U.S. Pat. No. 3,152,904; and photoconductive substances (e.g., titanium dioxide and zinc oxide).

Of these, photosensitive silver halides are most preferred because of their high sensitivity. Suitable photosensitive silver halides that can be used are silver chloride, silver bromide, silver iodide, silver chlorobromoiodide, silver chlorobromide, silver chloroiodide, silver iodobromide, and mixtures thereof. A suitable amount of the photo catalyst (b) is about 0.001 mol to about 0.7 mol, preferably about 0.01 mol to about 0.5 mol, per mol of the organic silver salt (a).

Two methods can be used to incorporate the photo catalyst (b) into the thermally developable light-sensitive material of this invention.

A first method comprises preparing the photo catalyst in advance, and mixing the photo catalyst with a separately prepared organic silver salt (a), preferably in the presence of a polymer binder, as described, for example, in U.S. Pat. No. 3,152,904 and British Pat. No. 1,362,970. The photo catalyst used in this invention may be prepared using known processes. For example, the photosensitive silver halide used in this method may be a Lipmann emulsion, an ammonia-method emulsion, or a thiocyanate or thioether ripened emulsion prepared using known methods such as a single jet method or a double jet method. Preferred silver halides that can be used in this mixing method are those which are produced by known improved processes disclosed in, for example, U.S. Pat. Nos. 3,761,273, 3,706,565, 3,706,564 and 3,713,833, and U.S. Application Ser. No. 680,417, filed Apr. 26, 1976 now U.S. Pat. No. 4,120,728.

A second method for incorporating the photo catalyst, especially a photosensitive silver halide, into the light-sensitive material involves causing a photosensitive silver halide-forming agent to act on a solution or dispersion of the organic silver salt (a) prepared in advance, thereby to convert a part of the organic silver salt to photosensitive silver halide. The types of the photosensitive silver halide-forming agents and specific procedures for production are described, for example, in Japanese Patent Application (OPI) No. 35623/77.

Examples of suitable silver halide-forming agents which can be used are given below:

(1) Inorganic halogen compounds such as halides of the formula $M'X_n$ wherein M' represents H, $NH_4$ or a metal atom, X represents Cl, Br or I, and n is 1 when M' is H or $NH_4$, and when M' is a metal atom, n represents the atomic valence of the metal atoms. Examples of suitable metals for M' are lithium, sodium, potassium, cesium, magnesium, calcium, strontium, barium, zinc, cadmium, mercury, tin, antimony, chromium, manganese, iron, cobalt, nickel, rhodium, and cerium.

(2) Onium halides, for example, quaternary ammonium halides such as trimethylphenyl ammonium bromide, cetylethyldimethyl ammonium bromide and trimethylbenzyl ammonium bromide; quaternary phosphonium halides such as tetraethyl phosphonium bromide; tertiary sulfonium halides such as trimethyl sulfonium iodide; etc.

(3) Halogenated hydrocarbons such as iodoform, bromoform, carbon tetrabromide, and 2-bromo-1-methylpropane.

(4) N-halo compounds such as N-chlorosuccinimide, N-bromosuccinimide, N-bromophthalimide, N-bromoacetamide, N-iodosuccinimide, N-bromophthalazone, N-bromooxazolinone, N-chlorophthalazone, N-bromoacetanilide, N,N-dibromobenzene sulfonamide, N-bromo-N-methylbenzene sulfonamide, 1,3-dibromo-4,4-dimethyl hydantoin, N-bromourazole, etc.

(5) Other halogen-containing compounds such as triphenylmethyl chloride, triphenylmethyl bromide, 2-bromobutyric acid, 2-bromoethanol, dichlorobenzophenone, triphenyl bromide, etc.

The silver halide-forming agents described above can be used individually or as a mixture of two or more thereof.

A suitable amount of the silver halide-forming agent is about 0.001 to about 0.7 mol, preferably about 0.01 mol to about 0.5 mol, per mol of the organic silver salt (a). When the amount of the silver halide-forming agent is below about 0.001 mol, the sensitivity of the resulting light-sensitive material is low. When the amount of the silver halide-forming agent is larger than about 0.7 mol, light discoloration (undesired coloration of the background when the processed light-sensitive material is allowed to stand under normal room illumination) increases.

The photo catalyst incorporated using any of the above methods can be sensitized by sensitizing dyes or compounds as described in Japanese Patent Application (OPI) No. 36020/77.

The reducing agent, which is used as component (c) in the present invention, is a compound which is capable of reducing the organic silver salt (component (a)) upon imagewise heating or heating in the presence of an exposed photo catalyst (b) on heating at a temperature of about 80° C. or higher, more preferably 100° C. or higher. Although component (c) is most preferably incorporated into a layer in which component (a) is present, component (c) can be occasionally incorporated into a layer adjacent a layer in which component (a) is present. In the latter case, the recording layer is divided into two layers.

Examples of reducing agents suitable for use in the present invention as component (c) include mono-, bis, tris- or tetrakis-phenols; mono- or bis-naphthols; di- or poly-hydroxynaphthalenes; di- or poly-hydroxybenzenes; hydroxymonoethers; ascorbic acids; 3-pyrazolidones; pyrazolines; pyrazolones; reducing saccharides; phenylenediamines; hydroxylamines; reductones; hydroxyoxaminic acids; hydrazides; amidoximes; and N-hydroxyureas. Specific examples of these reducing agents are described in detail in, e.g., Japanese Patent Application (OPI) No. 22431/76, U.S. Pat. Nos. 3,615,533, 3,679,426, 3,672,904, 3,751,252, 3,751,255, 3,782,949, 3,801,321, 3,794,488 and 3,893,863, Belgian Pat. No. 786,086, U.S. Pat. Nos. 3,770,448, 3,819,382, 3,773,512, 3,928,686, 3,839,048 and 3,887,378, Japanese Patent Application (OPI) Nos. 15541/75 and 36143/75, U.S. Pat. No. 3,827,889, Japanese Patent Application (OPI) Nos. 36110/75, 116023/75, 117711/75 and 23721/76, U.S. Pat. No. 4,021,249 and Japanese Patent Application (OPI) No. 51933/76. A suitable reducing agent for use can be selected from these reducing agents, taking into account the kinds and properties of the organic silver salts employed in combination therewith.

Polyphenols, sulfonamidophenols and naphthols, of these compounds, are particularly preferred as reducing agents.

Preferred examples of polyphenols are 2,4-dialkyl-substituted ortho-bisphenols, 2,6-dialkyl-substituted parabisphenols or mixtures thereof. Specific examples of such compounds include 1,1-bis(2-hydroxy-3,5-dimethylphenyl)-3,5,5-trimethylhexane, 1,1-bis(2-hydroxy-3-t-butyl-5-methylphenyl)-methane, 1,1-bis(2-hydroxy-3,5-di-t-butylphenyl)methane, 6-methylenebis(2-hydroxy-3-t-butyl-5-methylphenyl)-4-methylphenol, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylproapne, 1,1,5,5-tetrakis(2-hydroxy-3,5-dimethylphenyl)-2,4-ethylpentane, 2,2-bis(4-hydroxy-3,5-dimethylphenyl)propane, 2,2-bis(4-hydroxy-3-methyl-5-t-butylphenyl)propane and 2,2-bis-(4-hydroxy-3,5-di-t-butylphenyl)propane.

Preferred examples of naphthols include 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, 4,4'-dimethoxy-1,1'-dihydroxy-2,2'-binaphthyl and so on.

Preferred examples of sulfonamidophenols include 4-benzenesulfonamidophenol, 2-benzenesulfonamidophenol, 2,6-dichloro-4-benzenesulfonamidophenol and the like.

Of these reducing agents, mono-, bis-, tris- or tetrakis-phenols having at least one alkyl group as a substituent, such as a methyl group, an ethyl group, a propyl group, an isopropyl group or a butyl group, or an acyl group as a substituent at a position adjacent the position substituted with a hydroxy group, where the hydroxy group is connected to a carbon atom in the aromatic nucleus, for instance, a 2,6-di-t-butylphenol group, are particularly advantageous, since they are stable to light and, therefore, only a slight coloration occurs.

In addition, reducing agents of the kind which undergo photolysis and are rendered inert to light, as disclosed in U.S. Pat. No. 3,827,889, have the advantage in that coloration can be prevented from occurring because the decomposition or the inactivation of such reducing agents by light occurs when the light-sensitive element is allowed to stand under normal room illumination after development and no further progress of the reduction occurs. Examples of photolytic reducing agents which can be used in this invention include ascorbic acid or derivatives thereof, furoin, benzoin, dihydroxyacetone, glyceraldehyde, tetrahydroxyquinone rhodizonate, 4-methoxy-1-naphthol and aromatic polysulfur compounds as disclosed in Japanese Patent Application (OPI) No. 99719/75. Direct positive images can be produced when thermally developable light-sensitive elements are prepared using such photolytic reducing agents and, then are imagewise exposed to light to destroy the reducing agents as disclosed in U.S. Pat. Nos. 3,827,899 and 3,756,829. Further, compounds accelerating the photolytic decomposition of the reducing agents can be used in combination with such reducing agent.

A suitable reducing agent is selected by taking into account the kind (oxidizability) of the organic silver salt (component (a)) employed in combination therewith. For instance, reducing agents having a strong reducing activity are suitable for use with silver salts which are comparatively difficult to reduce, such as silver benzotriazole and silver behenate. On the other hand, for relatively easily reducible organic silver salts such as silver caprate and silver laurate, comparatively weak reducing agents are suitable. Specific examples of appropriate reducing agents for silver benzotriazole include 1-phenyl-3-pyrazolidones, ascorbic acid, ascorbic acid monocarboxylic acid esters, and naphthols such as 4-methoxy-1-naphthols. Suitable reducing agents for silver behenate are o-bisphenols of the bis(hydroxyphenyl)methane system, hydroquinone and other various kinds of reducing agents. Suitable examples of reducing agents for silver caprate and silver laurate are substituted tetrakisphenols, o-bisphenols of the bis(hydroxyphenyl)alkane system, p-bisphenols such as substituted compounds of bisphenol A and p-phenylphenol.

The simplest method for choosing a suitable reducing agent by one skilled in the art is by trial and error, wherein light-sensitive materials are prepared, e.g., as described in the examples hereinafter, and the photographic characteristics are examined. The suitability or lack of suitability of the reducing agents used is determined by the results obtained.

The amount of the reducing agent employed will vary depending upon the kind of organic silver salt and the reducing agent used, and the presence of other additives. However, in general, amounts of about 0.05 to about 10 mol, and preferably about 0.1 to 3 mol, per mol of the organic silver salt (a) are suitable.

The above-described various types of reducing agents may be used individually or as a combination thereof, if desired.

Component (d) used in this invention does not substantially possess a toning action as stated hereinabove. Hence, use of a toning agent is preferred. A suitable amount of the toning agent which can be used is about 0.01 to about 0.5 mol per mole of component (a). Especially when a fatty acid silver salt is used as the organic silver salt (a) and an ortho-bisphenol or para-bisphenol is used as the reducing agent, the use of a toning agent produces an advantageous result. However, when a sulfonamide phenol is used as the reducing agent, it is not always necessary to use a toning agent.

Examples of preferred toning agents which can be used in this invention include the cyclic imide compounds disclosed, for example, in British Pat. No. 1,380,795, the benzoxazinediones disclosed, for example, in U.S. Pat. Nos. 3,951,660 and 3,885,967, the phthalazinediones disclosed, for example, in Japanese Patent Application (OPI) Nos. 67641/75 and 32927/75, and the uracils disclosed, for example, in Japanese Patent Application (OPI) No. 114217/75. Of these, the benzoxazinediones are especially preferred.

Suitable benzoxazinediones are represented by the following general formula (III):

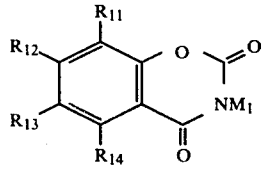

(III)

wherein $R_{11}$, $R_{12}$, $R_{13}$ and $R_{14}$, which may be the same or different, each represents a hydrogen atom, a halogen atom (e.g., Cl, Br, I), a hydroxy group, a nitro group, $-NH_2$ or a carbon-containing substituent group containing 1 to 20 carbon atoms. The carbon-containing substituent group described above for $R_{11}$, $R_{12}$, $R_{13}$ and $R_{14}$ may contain an oxygen atom, a nitrogen atom, a sulfur atom, a halogen atom or the like.

$M_1$ in the general formula (III) represents a hydrogen atom, a hydroxymethyl group or a univalent metal atom.

Further in the general formula (III), $R_{11}$ and $R_{12}$, $R_{12}$ and $R_{13}$, or $R_{13}$ and $R_{14}$ may, further, combine and form an aromatic ring by condensing with each other.

Specific examples of carbon-containing substituent groups represented by $R_{11}$, $R_{12}$, $R_{13}$ and $R_{14}$ include alkyl groups containing 1 to 4 carbon atoms, such as a methyl group, an ethyl group, a propyl group, etc.; haloalkyl groups containing 1 to 4 carbon atoms, such as a chloromethyl group, a $\beta$-bromoethyl group, etc.; hydroxyalkyl groups containing 1 to 4 carbon atoms, such as a hydroxymethyl group, a $\gamma$-hydroxypropyl group, etc.; alkoxy groups containing 1 to 4 carbon atoms, such as a methoxy group, an ethoxy group, a butoxy group, etc.; cycloalkyl groups containing 5 to 12 carbon atoms, such as a cyclopentyl group, a cyclohexyl group, etc.; alkyl-substituted amino groups containing 1 to 4 carbon atoms, such as a dimethylamino group, a diethylamino group, etc.; acyl groups containing 2 to 4 carbon atoms, such as an acetyl group, a propionyl group, etc.; alkenyl groups containing 3 to 6 carbon atoms, such as an allyl group, etc.; alkylthio groups containing 1 to 4 carbon atoms, such as a methylthio group, an ethylthio group, etc.; and so on.

Preferred examples of univalent metal atoms represented by $M_1$ in the general formula (III) include lithium, sodium, potassium, rubidium and cesium atoms.

Preferred examples of aromatic rings which may be formed by the combination of $R_{11}$ and $R_{12}$, $R_{12}$ and $R_{13}$, or $R_{13}$ and $R_{14}$ include a benzene ring and a naphthalene ring.

Of the benzoxazinediones described above, those which are unsubstituted or contain at least one electron-donating substituent are suitable. Most preferred examples of benzoxazinediones are described below (an electron-donating substituent is one empirically having a negative Hammett substituent $\sigma$ constant).

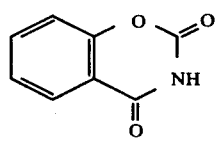

(1)

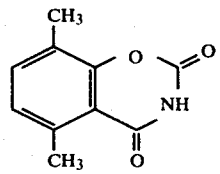

(2)

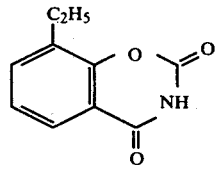

(3)

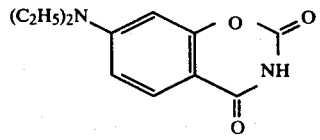

(4)

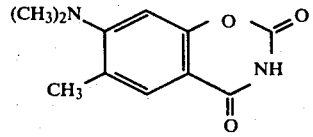

(5)

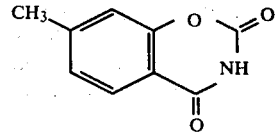

(6)

-continued (7)

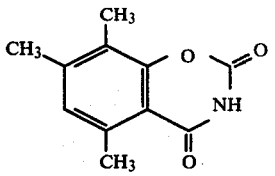

(8)

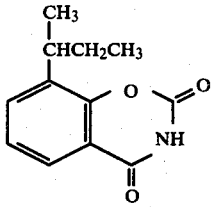

(9)

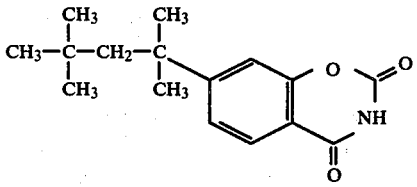

(10)

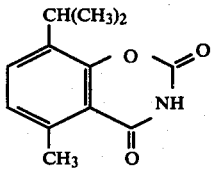

(11)

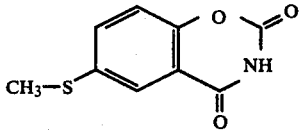

(12)

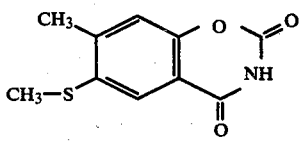

(13)

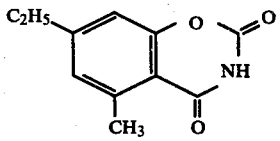

(14)

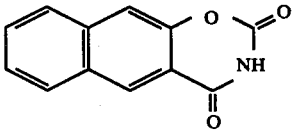

(15)

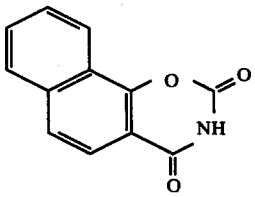

(16)

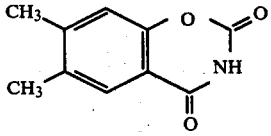

-continued (17)

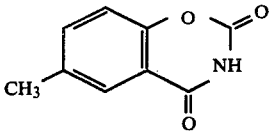

(18)

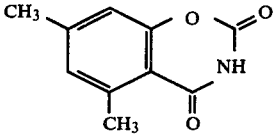

(19)

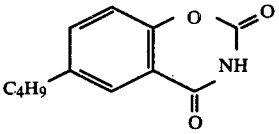

(20)

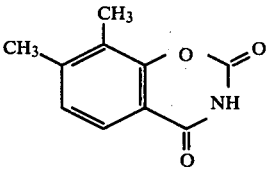

(21)

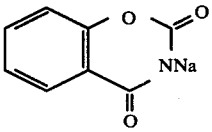

(22)

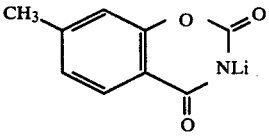

Component (d) used in this invention may be used alone or in combination with various known stabilizers. Suitable known stabilizers include, for example, N-halo compounds disclosed, for example, in British Pat. Nos. 1,389,501 and 1,425,817; lithium carboxylates disclosed, for example, in U.S. Pat. No. 3,885,968 and Japanese Patent Publication No. 47419/76; iron-group compounds disclosed, for example, in Japanese Patent Application (OPI) No. 134421/75; cerium compounds disclosed, for example, in Japanese Patent Application (OPI) No. 24520/77; sulfinic acids disclosed in, for example, British Patent 1,476,875; thiosulfonic acids disclosed in, for example, Japanese Patent Application (OPI) No. 78227/76.

Of these stabilizers, the thiosulfonic acids are preferred. Specifically, preferred thiosulfonic acids can be expressed by the following general formula (IV):

$$RSO_2SM_2 \qquad \text{(IV)}$$

wherein R represents (1) a substituted or unsubstituted aliphatic group or (2) a substituted or unsubstituted aromatic group, and $M_2$ represents a cation other than a hydrogen ion. Preferably, R represents an alkyl group having 22 or less carbon atoms, or such an alkyl group substituted with one or more of an alkoxy group having 1 to 8 carbon atoms or an aryl group having 6 to 18 carbon atoms, or an aryl group having 6 to 30 carbon atoms or such an aryl group substituted with one or more of an alkyl group having 1 to 8 carbon atoms, an alkaryl group having 7 to 14 carbon atoms or an aryl group having 6 to 18 carbon atoms. $M_2$ is preferably an alkali metal ion (e.g., $Li^+$, $Na^+$, $K^+$, $Rb^+$ or $Cs^+$) or an alkaline earth metal ion (e.g., $Be^{2+}$, $Mg^{2+}$, $Ca^{2+}$, $Sr^{2+}$ or $Ba^{2+}$).

Specific examples of suitable thiosulfonic acids are sodium n-octylthiosulfonate, potassium n-dodecylthiosulfonate, potassium n-dodecanethiosulfonate, sodium benzylthiosulfonate, sodium n-undecanethiosulfonate, potassium n-tetradecanethiosulfonate, lithium benzylthiosulfonate, potassium n-hexadecanethiosulfonate, potassium 2-ethoxyethylthiosulfonate, sodium benzenethiosulfonate, lithium benzenethiosulfonate, potassium benzenethiosulfonate, sodium p-toluenethiosulfonate, potassium p-methoxybenzenethiosulfonate, potassium p-ethoxybenzenethiosulfonate, sodium 2-naphthylthiosulfonate, potassium 3-t-butylbenzenethiosulfonate, sodium 3,4-dimethylbenzenethiosulfonate, potassium 3-chlorobenzenethiosulfonate, sodium 4-nitrobenzenethiosulfonate, and potassium 3-acetylbenzenethiosulfonate. These thiosulfonic acid compounds can be used either individually or as a mixture of two or more thereof.

A suitable amount of the thiosulfonic acid compound is about $10^{-5}$ to about 1 mol, preferably $6\times10^{-4}$ to $10^{-1}$ mol, per mol of the organic silver salt (a). When the amount of the thiosulfonic acid compound is below about $10^{-5}$ mol, sufficient heat fog prevention by the combined use of the thiosulfonic acid compound with component (d) is not obtained. On the other hand, if the amount of the thiosulfonic acid compound is above about 1 mol, the development is inhibited, and the maximum density of the developed image becomes undesirably low.

The components used in this invention are preferably dispersed in at least one colloid as a binder. In performing the dispersion, each component can be added in the form of a solution or dispersion thereof. Any desired solvent may be used, and the non-flammable solvents disclosed in British Patent 1,422,145 are preferred. Suitable binders are generally hydrophobic, but hydrophilic binders can also be used. These binders are transparent or semi-transparent, and preferably white or lightly colored. Specific examples of suitable binders are proteins such as gelatin, cellulose derivatives, polysaccharides such as dextrin, natural substances such as gum arabic, and synthetic polymers. Suitable binders are disclosed, for example, in Japanese Patent Application (OPI) Nos. 22431/76, 126498/75, 29126/76, 19525/76 and 84443/74. Especially preferred binders are, for example, polyvinyl butyral, polyvinyl acetate ethyl cellulose, a vinylidene chloride/vinyl chloride copolymer, polymethyl methacrylate, a vinyl chloride/vinyl acetate copolymer, cellulose acetate butyrate, gelatin, and polyvinyl alcohol. If required, two or more of these binders may be used as a mixture. A suitable amount of the binder is such that the weight ratio of the binder to the organic silver salt (a) is about 10:1 to about 1:10, preferably about 4:1 to about 1:4.

Layers containing the individual components (a) to (d) used in the thermally developable light-sensitive material of this invention and the other layers to be described below can be coated on various supports which can be selected from a wide range of materials. The coating can be accomplished by known methods such as dip coating, air knife coating, roller coating, gravure coating, curtain coating or hopper coating. The support can have any shape, and the support preferably is flexible for easy handling as an information recording material. The support can be in the form of a film, a sheet, a roll or a ribbon. Examples of suitable materials for the support are synthetic resin films (for example, a cellulose triacetate film, a polyethylene terephthalate film, etc.) and sheets, glass, wool, cotton, paper, and metals such as aluminum.

The thermally developable light-sensitive material of this invention may also have auxiliary layers suitable for particular purposes, such as a vacuum-deposited metal layer, a backing layer, a subbing layer, a top polymer layer, and an antihalation layer. These auxiliary layers can be provided by using the materials and methods described in Japanese Patent Application (OPI) Nos. 43130/76, 136099/75 and 36020/77, U.S. Pat. No. 3,748,137 and British Pat. No. 1,261,102.

The thermally developable light-sensitive material of this invention can be prepared specifically, for example, using the following method. First, an organic silver salt is prepared by reacting an organic silver salt-forming agent with a silver ion supplying agent such as silver nitrate using the various methods described hereinabove. The organic silver salt is then dispersed in a binder for an emulsion, if required, after the organic silver salt has been washed with water or an alcohol (e.g., methanol, ethanol, isopropanol, etc.). The dispersing can be performed using a colloid mill, a mixer, a ball mill, etc. Alternatively, the organic silver salt may be prepared in the presence of a binder. To the polymer dispersion of the organic silver salt so prepared is added a silver halide-forming agent to convert a part of the organic silver salt to the corresponding silver halide. Alternatively, the silver halide may be separately prepared, and added to the dispersion. If desired, the silver halide can also be prepared at the same time as the preparation of the organic silver salt. Then, various additives such as a sensitizing dye, a reducing agent and a toning agent, preferably in the form of solutions thereof, are added successively to the polymer dispersion of the organic silver salt. Upon addition of all of the essential materials and the additives, a coating composition results. Usually, the coating composition, without drying, is coated on a suitable support. Thus, a thermally developable light-sensitive layer is formed. A top coated polymer layer, a subbing layer, a backing layer, and the other layers can be formed by successively coating these layers by coating compositions for the respective layers using the various coating methods described above. If desired, two or more of these layers can be simultaneously coated by methods disclosed, for example, in U.S. Pat. No. 2,761,791 and British Pat. No. 837,095.

Any desired solvents can be used to prepare the coating compositions. The non-flammable solvents described in British Pat. No. 1,422,145 can also be used.

If desired, the surface of or the back of the support, or a layer coated on the support may have printing thereon. Printing is used for, e.g., railway and bus tickets or the like, postcards and other documents.

The thermally developable light-sensitive material so prepared is stored, preferably, in a sheet or roll form. For example, storage in the presence of a desiccant as described in Japanese Patent Publication No. 17247/76 and Japanese Patent Application (OPI) No. 2523/75 is preferred. In use, the light-sensitive material may be cut to suitable sizes before or after imagewise exposure or simultaneously with the imagewise exposure. The light-sensitive material may be preheated to about 80° to about 140° C. as described in Japanese Patent Application (OPI) No. 43630/73, and Japanese Patent Publication No. 29407/76. Alternatively, as described in Japanese Patent Application (OPI) No. 128525/75, a polar solvent may be applied to the light-sensitive material before or during imagewise exposure. Alternatively, the material can be rendered light-sensitive for the first time by preheating the material before imagewise exposure, as described in U.S. Pat. Nos. 3,802,888, 3,764,329, and 3,816,132, and Japanese Patent Application (OPI) Nos. 87920/73, 10039/74 and 91214/74.

An image is formed by treating the resulting thermally developable light-sensitive material of this invention in the following manner.

First, the thermally developable light-sensitive material of this invention is cut to a size suitable for use, and imagewise exposed. Suitable light sources for the imagewise exposure are a tungsten lamp, a copying fluorescent lamp used mainly for exposing diazo light-sensitive materials, a mercury lamp, an iodine lamp, a xenon lamp, a CRT light source and a laser light source. The image-bearing original may, for example, be a line image such as an engineering drawing, or a photographic image with gradation. Alternatively, a picture of a person or of a landscape may be photographed using the light-sensitive material in a camera. Exposure may be performed by contact printing with the original being superimposed on the light-sensitive material, or by reflection printing, or by enlargement printing. The amount of exposure will vary depending on the sensitivity of the light-sensitive material. Highly sensitive materials require an exposure of about 10 lux.sec., and materials with low sensitivity require an exposure of about $10^4$ lux.sec.

The light-sensitive material thus imagewise exposed can be developed merely by heating to about 80° to about 180° C., preferably to about 100° to about 150° C. The heating time can be freely adjusted depending upon the heating temperature, and generally is, for example, about 1 to 60 seconds. Various means are available to heat the exposed light-sensitive material. For example, the light-sensitive material can be contacted with a simple heated plate, or with a heated drum. If desired, the light-sensitive material may be passed through a heated space. Furthermore, as described in U.S. Pat. No. 3,811,885, the light-sensitive material may be heated by high-frequency induction heating or laser beams. To remove offensive odors generated during heating, a deodorant may be used after heating. Alternatively, it is possible to incorporate a certain perfume which makes the odor of the light-sensitive material imperceptible.

Thus, a clear and stable silver image can be formed.

The thermally developable light-sensitive material in accordance with this invention can be used in various applications. For example, the light-sensitive material can be used to record a direct positive image as described in U.S. Pat. Nos. 3,607,282 and 3,589,901. The light-sensitive material can be made into a planographic printing plate as described in Japanese Patent Application (OPI) No. 4659/72, and U.S. Pat. Nos. 3,679,414 and 3,811,886. The light-sensitive material can also be employed as a thermographic transfer sheet as described in U.S. Pat. Nos. 3,767,394 and 3,859,094 and Japanese Patent Publication No. 13023/76. The light-sensitive material can also be employed in the preparation of season tickets for railways, buses, etc., as described in Japanese Patent Application (OPI) Nos. 87318/75 and 125737/75 and Japanese Patent Publication No. 4107/76. Moreover, as described in Japanese Patent Application (OPI) No. 89736/76, if there is a heating step in other photographic processes, the heating can be simultaneously utilized for the thermally development of the light-sensitive material of this invention.

The following examples are given to illustrate the present invention in more detail. Unless otherwise indicated herein, all parts, percents, ratios and the like are by weight.

EXAMPLE 1

34 g of behenic acid and 500 ml of water were mixed, and heated to 85° C. to melt the behenic acid. While the mixture of the melted behenic acid and water was stirred at 1,800 rpm, an aqueous solution of sodium hydroxide (2.0 g of sodium hydroxide+50 ml (25° C.) of water) was added over the course of 3 minutes to form a mixture of sodium behenate and behenic acid. With stirring at 1,800 rpm, the temperature of the mixture was decreased from 85° C. to 30° C.

With continued stirring, an aqueous solution of silver nitrate (8.5 g of silver nitrate+50 ml (25° C.) of water) was added over the course of 3 minutes, and the mixture was further stirred for 90 minutes. Then, 200 ml of isoamyl acetate was added thereto. The resulting silver behenate particles were recovered, and dispersed in an isopropanol solution of polyvinyl butyral (25 g of polyvinyl butyral+200 ml of isopropanol) using a homogenizer at 25° C. and 3,000 rpm for 30 minutes to form a polymer dispersion of silver behenate.

While the polymer dispersion of silver behenate was maintained at 50° C. and was being stirred at 500 rpm, an acetone solution of N-bromosuccinimide (0.7 g of N-bromosuccinimide+50 ml (25° C.) of acetone) was added. The mixture was stirred further for 60 minutes to form a polymer dispersion of silver bromide and silver behenate.

1/240 mol of the polymer dispersion of the silver bromide and silver behenate was taken and maintained at 30° C. With stirring at 200 rpm, the following components were added at 5 minute intervals to prepare a Coating Solution (A).

| | |
|---|---|
| (i) Merocyanine Dye (sensitizing dye)* (0.025 wt % ethylene glycol monomethyl ether solution) | 2 ml |
| (ii) Sodium Benzenethiosulfonate (0.01 wt % methanol solution) | 2 ml |
| (iii) Benzoxazinedione (toning agent) (3 wt % ethylene glycol monomethyl ether) | 8 ml |
| (iv) 4-Bromophthalimide (component (d) of this invention) (1 wt % ethylene glycol monomethyl ether solution) | 2 ml |
| (v) o-Bisphenol (reducing agent)** | 10 ml |

-continued (10 wt % acetone solution)

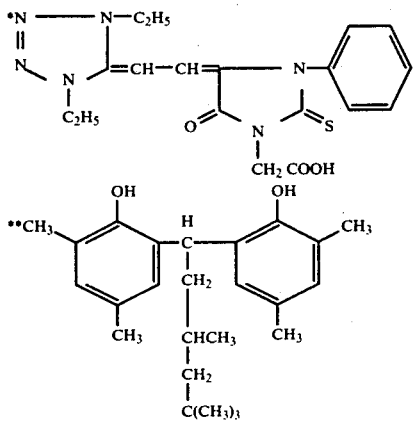

For comparison, Coating Solution (B) was prepared in the same manner as above except that the 4-bromophthalimide (iv) was not employed.

For further comparison, Coating Solution (C) was prepared in the same manner as in the preparation of Coating Solution (A) except that the benzoxazinedione (iii) was not employed.

Each of the three Coating Solutions (A), (B) and (C) so prepared was coated on a support (a raw paper for pressure-sensitive sheets having polyvinyl alcohol coated thereon as a subbing layer) so that the amount of silver was 0.3 g per $m^2$. Thus, thermally developable Light-Sensitive Materials (A), (B) and (C) were prepared.

Each of these Light-Sensitive Materials (A), (B) and (C) was imagewise exposed through an optical wedge using light from a tungsten lamp (maximum amount of exposure: 3,000 CMS), and then contacted with a heated plate at 130° C. for 8 seconds.

On the other hand, samples of unexposed thermally developable Light-Sensitive Materials (A) and (B) were sealed in a vinyl resin bag containing silica gel, and stored for 1 month at 35° C. (hereinbelow referred to forced deterioration testing). Then, these Light-Sensitive Materials (A) and (B) were each imagewise exposed and thermally developed under the same conditions as described above.

The reflection densities of these samples were measured to evaluate the photographic performance thereof. The results obtained are shown in Table 1 below.

Table 1

| Sample No. | Additive (iii) | Additive (ii) | Before Forced Deterioration Fog | Before Forced Deterioration $D_{max}$ | Before Forced Deterioration Relative* Sensitivity | After Forced Deterioration Fog | After Forced Deterioration $D_{max}$ | After Forced Deterioration Relative* Sensitivity |
|---|---|---|---|---|---|---|---|---|
| (A) | Yes | Yes | 0.08 | 1.35 | 106 | 0.08 | 1.33 | 85 |
| (B) | Yes | No | 0.14 | 1.34 | 100 | 0.21 | 1.31 | 63 |
| (C) | No | Yes | 0.06 | 0.08 | — | — | — | — |

*The relative sensitivity calculated when the sensitivity of the thermally developable Light-Sensitive Material (B) before the forced deterioration was taken as 100. The sensitivity is expressed as the reciprocal of the amount of exposure required to obtain a density of (fog + 1).

The results in Table 1 show that less heat fog was produced in the thermally developable Light-Sensitive Material (A) of this invention than in the Light-Sensitive Material (B) both before and after forced deterioration. It can also be seen that with the additive (iv) (4-bromophthalimide) alone, an image of a high $D_{max}$ value cannot be obtained, and a toning agent is necessary.

Comparative Example 1

Coating Solution (D) was prepared in the same manner as in the preparation of Coating Solution (A) in Example 1 except that a 0.65 wt% ethylene glycol monomethyl ether solution of phthalimide was employed instead of the 4-bromophthalimide. Coating Solution (D) was coated on a support paper to form a thermally developable Light-Sensitive Material (D).

Light-Sensitive Material (D) was tested in the same manner as in Example 1. The results obtained are shown in Table 2 below.

Table 2

| Sample No. | Additive (iv) | Before Forced Deterioration Fog | Before Forced Deterioration $D_{max}$ | Before Forced Deterioration Relative Sensitivity | After Forced Deterioration Fog | After Forced Deterioration $D_{max}$ | After Forced Deterioration Relative Sensitivity |
|---|---|---|---|---|---|---|---|
| (B) | None | 0.14 | 1.34 | 100 | 0.21 | 1.31 | 63 |
| (D) | Phthalimide | 0.15 | 1.35 | 100 | 0.23 | 1.33 | 62 |

The results in Table 2 above show that phthalimide not containing an electron-attracting substituent does not have an action of reducing heat fog.

Comparative Example 2

Coating Solution (E) was prepared in the same manner as in the preparation of Coating Solution (A) in Example 1 except that the benzoxazinedione was not employed, and the concentration of 4-bromophthalimide was changed to 3.9% by weight and the amount of the solution thereof added was changed to 8 ml.

Coating Solution (F) was prepared in the same manner as in the preparation of Coating Solution (A) in Example 1 except that the benzoxazinedione was not employed, and a 2.5 wt% ethylene glycol monomethyl ether solution of phthalimide was employed instead of the 4-bromophthalimide.

Coating Solution (G) was also prepared in the same manner as in the preparation of Coating Solution (A) except that the benzoxazinedione and 4-bromophthalimide were not employed.

Each of Coating Solutions (E), (F) and (G) was coated in the same manner as in Example 1 to produce thermally developable Light-Sensitive Materials (E), (F) and (G).

These light-sensitive materials were each exposed and thermally developed under the same conditions as in Example 1. The results obtained are shown in Table 3 below.

Table 3

| Sample No. | Additive (iv) | Mols | Fog | $D_{max}$ | Color |
|---|---|---|---|---|---|
| (E) | 4-Bromophthalimide (3.9%, 8 ml | $1.38\times10^{-3}$ | 0.05 | 0.05 | — |
| (F) | Phthalimide (2.5%, 8 ml) | $1.36\times10^{-3}$ | 0.12 | 1.18 | Black brown |
| (G) | — | — | 0.05 | 0.05 | — |

It can be seen from the results in Table 3 that 4-bromophthalimide which has an electron-attracting substituent does not have a toning action or a development promoting action.

EXAMPLES 2 TO 5

Thermally developable Light-Sensitive Materials (H), (I), (J) and (K) were produced in the same manner as in Example 1 except that 4-chlorophthalimide, 4-nitrophthalimide, 3-bromophthalimide and 4-cyanophthalimide, each in ethylene glycol monomethyl ether, were added in the amounts indicated in Table 4 below instead of 4-bromophthalimide in the preparation of Coating Solution (A).

Table 4

| Sample No. | Additive | Amount |
|---|---|---|
| (H) | 4-Chlorophthalimide (2.5%) | 2 ml |
| (I) | 4-Nitrophthalimide (1%) | 2 ml |
| (J) | 3-Bromophthalimide (1%) | 2 ml |
| (K) | 4-Cyanophthalimide (1%) | 2 ml |
| (B) | — | — |

Each of the thermally developable Light-Sensitive Materials (H), (I), (J), (K) and (B) was tested in the same manner as in Example 1, and the results obtained are shown in Table 5 below.

Table 5

| | Before Forced | | | After Forced | | |
|---|---|---|---|---|---|---|
| | | | | Deterioration | | |
| Example No. | Sample No. | Fog | $D_{max}$ | Relative Sensitivity | Fog | $D_{max}$ | Relative Sensitivity |
| 2 | (H) | 0.09 | 1.33 | 104 | 0.09 | 1.33 | 83 |
| 3 | (I) | 0.08 | 1.32 | 101 | 0.09 | 1.32 | 80 |
| 4 | (J) | 0.08 | 1.35 | 107 | 0.08 | 1.33 | 84 |
| 5 | (K) | 0.08 | 1.36 | 108 | 0.09 | 1.35 | 87 |
| 1 | (B) | 0.14 | 1.34 | 100 | 0.21 | 1.31 | 63 |

It is seen from the results in Tables 4 and 5 above that the thermally developable light-sensitive materials of this invention have reduced fog before and after forced deterioration.

EXAMPLE 6

Thermally developable Light-Sensitive Materials (L), (M), (N) and (O) were prepared in the same manner as in Example 1 except as described below.

A thermally developable Light-Sensitive Material (L) was prepared in the same manner as in Example 1 except that in the preparation of Coating Solution (A), 10 ml of an 8% by weight acetone solution of a sulfonamide phenol of the following formula

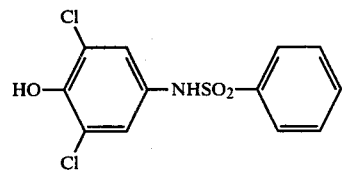

was used instead of the o-bisphenol.

For comparison, a thermally developable Light-Sensitive Material (M) was prepared in the same manner as in the preparation of thermally developable Light-Sensitive Material (L) except that the 4-bromophthalimide was not employed.

A thermally developable Light-Sensitive Material (N) was prepared in the same manner as in Example 1 except that in the preparation of Coating Solution (C), 10 ml of an 8% by weight acetone solution of a sulfonamide phenol of the formula shown above was used instead of the o-bisphenol.

For comparison, a thermally developable Light-Sensitive Material (O) was produced in the same manner as in the preparation of thermally developable Light-Sensitive Material (N) except that the 4-bromophthalimide was not employed.

These thermally developable light-sensitive materials were each tested in the same manner as in Example 1. The results obtained are shown in Table 6 below.

Table 6

| Sample No. | 4-Bromophthalimide (iv) | Benzoxazinedione (iii) | Before Forced Deterioration | | | After Forced Deterioration | | |
|---|---|---|---|---|---|---|---|---|
| | | | Fog | $D_{max}$ | Relative* Sensitivity | Fog | $D_{max}$ | Relative* Sensitivity |
| (L) | Yes | Yes | 0.12 | 1.28 | 125 | 0.13 | 1.27 | 108 |
| (M) | No | Yes | 0.18 | 1.26 | 100 | 0.28 | 1.21 | 73 |
| (N) | Yes | No | 0.08 | 0.85 | 66 | 0.08 | 0.78 | 58 |
| (O) | No | No | 0.12 | 0.83 | 58 | 0.18 | 0.77 | 44 |

*The relative sensitivity calculated when the sensitivity of Light-Sensitive Material (M) before forced deterioration was taken as 100. The sensitivity is expressed as the reciprocal of the amount of exposure which is required to obtain a density of (fog+0.1).

The results in Table 6 show that when a sulfonamide phenol is used as a reducing agent, 4-bromophthalimide also prevents heat fog effectively.

It has also been found that when benzoxazinedione was not employed as a toning agent, 4-bromophthalimide also effectively prevents heat fog formation.

EXAMPLE 7

Coating Solution (P) was prepared in the same manner as in the preparation of Coating Solution (A) in Example 1 except that sodium benzenethiosulfonate was not employed.

For comparison, Coating Solution (Q) was prepared in the same manner as in the preparation of Coating Solution (P) except that 4-bromophthalimide was not employed.

Each of Coating Solutions (P) and (Q) so prepared was coated on a support paper (a raw paper for pressure-sensitive sheets having a polyvinyl alcohol layer as a subbing layer) so that the amount of silver was 0.3 g per $m^2$. Thus, two thermally developable Light-Sensitive Materials (P) and (Q) were produced.

These materials were sensitometrically tested under the same conditions as in Example 1. The results obtained are shown in Table 7 below.

Table 7

| Sample No. | 4-Bromo-phthal-imide | Before Forced Deterioration | | | After Forced Deterioration | | |
|---|---|---|---|---|---|---|---|
| | | Fog | $D_{max}$ | Relative* Sensi-tivity | Fog | $D_{max}$ | Relative* Sensi-tivity |
| (P) | Yes | 0.10 | 1.43 | 128 | 0.20 | 1.45 | 95 |
| (Q) | No | 0.17 | 1.40 | 110 | 0.75 | 1.42 | — |

*The relative sensitivity calculated when the sensitivity of Light-Sensitive Material (B) before forced deterioration was taken as 100.

The results in Table 7 show that Light-Sensitive Material (P) containing 4-bromophthalimide has less heat fog than does comparative Light-Sensitive Material (Q) both before and after forced deterioration.

It can also be seen from the results in Table 7 that Light-Sensitive Material (P) of the invention containing 4-bromophthalimide provides a higher image density and has a higher sensitivity in the absence of forced deterioration than does Light-Sensitive Material (B) containing benzenethiosulfonic acid, a known antifoggant, and after forced deterioration, exhibits less heat fog and lesser degrees in reduction of the image density and sensitivity, thus giving better storage stability in the unexposed state to thermally developable Light-Sensitive Material (P) than the known antifoggant.

While the invention has been described in detail and with reference to specific embodiments thereof, it will be apparent to one skilled in the art that various changes and modifications can be made therein without departing from the spirit and scope thereof.

What is claimed is:

1. A thermally developable light-sensitive material comprising a support having therein or in one or more layers thereon (a) an organic silver salt, (b) a photo catalyst and (c) a reducing agent and further containing (d) a phthalimide having at least one electron-attracting substituent thereon, wherein the electron-attracting substituent is selected from the group consisting of a cyano group, a halogen atom, a nitro group, an acyl group having 2 to 20 carbon atoms, an acyloxy group having 2 to 20 carbon atoms, an alkoxycarbonyl group having 2 to 20 carbon atoms, an acylamino group having 2 to 20 carbon atoms, an acylthio group having 2 to 7 carbon atoms and a sulfonamide group having 1 to 10 carbon atoms, wherein said phthalimide prevents heat fog in said thermally developable light-sensitive material and wherein said thermally developable light-sensitive material further contains a toning agent.

2. The thermally developable light-sensitive material of claim 1, wherein the electron-attracting substituent is a halogen atom.

3. The thermally developable light-sensitive material of claim 1 or 2, wherein the amount of the phthalimide (d) is about 0.001 to about 0.2 mol per mol of the organic silver salt (a).

4. The thermally developable light-sensitive material of claim 1, wherein said phthalimide has only electron-attracting substituents.

5. The thermally developable light-sensitive material of claim 1, further containing at least one benzoxazinedione.

6. The thermally developable light-sensitive material of claim 1, wherein said at least one electron-attracting substituent has a positive Hammett substituent $\sigma$ constant of $0<\sigma<1$.

7. The thermally developable light-sensitive material of claim 1, wherein said phthalimide, if it contains both an electron-attracting substituent and electron-donating substituent, has a half neutralization point higher than that of unsubstitued phthalimide or naphthalimide.

8. The thermally developable light-sensitive material of claim 7, wherein the half neutralization point is more than the half neutralization point of phthalimide or naphthalimide +10 mV.

9. The thermally developable light-sensitive material of claim 1, wherein said phthalimide is selected from the group consisting of 3-bromophthalimide, 4-bromophthalimide, potassium 4-bromophthalimide, lithium 4-bromophthalimide, sodium 4-bromophthalimide, 3,4-dibromophthalimide, 4-chlorophthalimide, 3-chlorophthalimide, 4,6-dibromophthalimide, 4,5-dichlorophthalimide, 3-fluorophthalimide, 4-fluorophthalimide, 3-iodophthalimide, 4-iodophthalimide, 3,6-iodophthalimide, 3,6-dichlorophthalimide, 3,4,5,6-tetrabromophthalimide, 3,4,5,6-tetrafluorophthalimide, 3,4,5,6-tetraiodophthalimide, 3-acetylaminophthalimide, 4-acetylaminophthalimide, 3-nitrophthalimide, 4-nitrophthalimide, 4-benzoylphthalimide, 3-cyanophthalimide, 4-cyanophthalimide, 3,4-dicyanophthalimide, 3-acetylamino-6-N,N-dimethylaminophthalimide, 3-acetylamino-6-nitrophthalimide, 3-chloro-4-methoxyphthalimide, 4-N,N-dimethylaminosulfophthalimide, 4-methoxyphthalimide, 3-acetylamino-6-bromophthalimide, 4-bromonaphthalimide, 4-nitronaphthalimide, 4-chloronaphthalimide, 3,5-dichloronaphthalimide, and 3,4,5-trichloronaphthalimide.

10. The thermally developable light-sensitive material of claim 1, wherein the electron-attracting substituent is a cyano group.

11. The thermally developable light-sensitive material of claim 1, wherein the electron-attracting substituent is a nitro group.

12. The thermally developable light-sensitive material of claim 1, wherein the electron-attracting substituent is an acyl group having 2 to 20 carbon atoms.

13. The thermally developable light-sensitive material of claim 1; wherein the electron-attracting substituent is an acyloxy group having 2 to 20 carbon atoms.

14. The thermally developable light-sensitive material of claim 1, wherein said toning agent is present in an amount of about 0.01 to about 0.5 mol per mol of component (a).

15. The thermally developable light-sensitive material of claim 14, wherein said toning agent is selected from the group consisting of cyclic amides, benzoxazinediones, phthalazinediones and uracils.

16. The thermally developable light-sensitive material of claim 1 or 2, wherein the phthalimide is selected from compounds of the general formula (I) and (II):

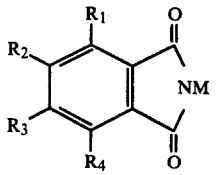

(I)

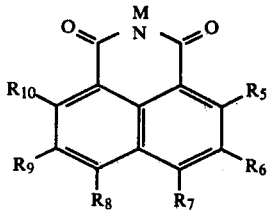

(II)

wherein M represents a monovalent metal atom; and at least one of $R_1$ to $R_4$ or $R_5$ to $R_{10}$ represents an electron-attracting substituent and the other of $R_1$ to $R_4$ or the other of $R_5$ to $R_{10}$, which may be the same or different, each represents a hydrogen atom, a hydroxy group, or a substituent containing 1 to 20 carbon atoms.

17. The thermally developable light-sensitive material of claim 16, wherein M is selected from the group consisting of a lithium atom, a sodium atom, a potassium atom, a rubidium atom and a cesium atom, and the carbon-containing substituent represented by any of $R_1$ to $R_4$ or $R_5$ to $R_{10}$ is selected from the group consisting of an alkyl group having 1 to 12 carbon atoms, an alkoxy group having 1 to 12 carbon atoms and an aryl group having 6 to 12 carbon atoms.

18. The thermally developable light-sensitive material of claim 16, wherein $R_1$ to $R_4$ and $R_5$ to $R_{10}$ which are not an electron-attracting substituent represent a hydrogen atom.

* * * * *